US007293334B2

(12) United States Patent
Metzger

(10) Patent No.: US 7,293,334 B2
(45) **Date of Patent: *Nov. 13, 2007**

(54) INTEGRAL ZIPPER SLIDE AND GUARD

(75) Inventor: Andrew T. Metzger, Belle Plaine, KS (US)

(73) Assignee: The Coleman Company, Inc., Wichita, KS (US)

( * ) Notice: Subject to any disclaimer, the term of this patent is extended or adjusted under 35 U.S.C. 154(b) by 543 days.

This patent is subject to a terminal disclaimer.

(21) Appl. No.: 10/441,783

(22) Filed: May 19, 2003

(65) Prior Publication Data

US 2003/0192151 A1 Oct. 16, 2003

Related U.S. Application Data

(63) Continuation-in-part of application No. 10/104,561, filed on Mar. 21, 2002, now Pat. No. 6,701,584.

(51) Int. Cl.
*A44B 19/26* (2006.01)

(52) U.S. Cl. ..... 24/415; 24/426

(58) Field of Classification Search ..... 24/399, 24/400, 415–420, 426–428, 430–436; D11/218, D11/221

See application file for complete search history.

(56) References Cited

U.S. PATENT DOCUMENTS

| | | | | |
|---|---|---|---|---|
| 1,681,550 | A | 8/1928 | Marinsky | |
| 1,813,227 | A | 7/1931 | Blair | |
| 2,056,172 | A | 10/1936 | DeVore | |
| 2,065,250 | A * | 12/1936 | Sundback | 24/415 |
| 2,177,344 | A | 10/1939 | Lange | |
| D118,050 | S | 12/1939 | Lawson | |
| 2,295,976 | A | 9/1942 | Suskowitz et al. | |
| 2,296,831 | A | 9/1942 | Bloxsom | |
| 2,379,059 | A | 2/1945 | Marinsky | |
| 2,568,163 | A | 9/1951 | Morin | |
| 2,677,162 | A | 5/1954 | Foltis | |
| 2,799,909 | A | 7/1957 | Dellaquila | |
| 2,807,853 | A | 10/1957 | Chery | |
| 2,819,505 | A | 1/1958 | Marcellus | |
| 2,824,352 | A | 2/1958 | Foltis | |
| 2,834,352 | A | 2/1958 | Foltis | |
| 2,840,877 | A | 7/1958 | Foltis | |
| 2,855,652 | A | 10/1958 | Jones | |
| 2,866,245 | A | 12/1958 | Elgin | |
| 2,882,578 | A * | 4/1959 | Morin | 24/416 |
| 2,933,792 | A | 4/1960 | Malmborg | |
| 3,337,929 | A | 8/1967 | McGahee | |
| 3,497,926 | A | 3/1970 | Frohlich | |

(Continued)

FOREIGN PATENT DOCUMENTS

| | | |
|---|---|---|
| DE | 818 033 | 10/1951 |

(Continued)

*Primary Examiner*—J J Swann
*Assistant Examiner*—David C Reese
(74) *Attorney, Agent, or Firm*—Leydig, Voit & Mayer, Ltd.

(57) ABSTRACT

An integral zipper slide and guard. The integral slide and guard is formed as a single unit, thus alleviating previous problems of attachment of zipper guards to zipper slides. Moreover, the unitary structure of the zipper slide and guard permits a one-step molding operation, thus providing inexpensive manufacture.

6 Claims, 2 Drawing Sheets

U.S. PATENT DOCUMENTS

| | | | | |
|---|---|---|---|---|
| 3,604,070 | A | 9/1971 | Vorsteher | |
| 3,822,443 | A | 7/1974 | Yoshida | |
| 3,857,125 | A | 12/1974 | Hunt | |
| 3,959,834 | A | 6/1976 | Hunt | |
| 4,023,244 | A | 5/1977 | Doguchi et al. | |
| D245,046 | S | 7/1977 | Weikal | |
| 4,121,326 | A * | 10/1978 | Kamiya | 24/426 |
| 4,238,871 | A | 12/1980 | Cannon | |
| 4,261,082 | A | 4/1981 | Kamiya | |
| 4,368,562 | A | 1/1983 | Minami | |
| 4,819,308 | A | 4/1989 | Baroky | |
| 4,997,222 | A | 3/1991 | Reed | |
| D325,007 | S | 3/1992 | Komuro | |
| 5,110,383 | A | 5/1992 | Kramer | |
| 5,181,299 | A | 1/1993 | Huang | |
| 5,497,535 | A | 3/1996 | Kloor | |
| D380,988 | S | 7/1997 | Mizuno | |
| D406,251 | S | 3/1999 | Nakamura | |
| 6,026,547 | A | 2/2000 | O'Donnell Kiely | |
| 6,490,770 | B1 | 12/2002 | Matsuda et al. | |
| 6,510,590 | B1 | 1/2003 | Lin | |
| 2003/0177615 | A1 * | 9/2003 | Metzger | 24/415 |
| 2003/0177616 | A1 * | 9/2003 | Petravic et al. | 24/415 |

FOREIGN PATENT DOCUMENTS

| | | |
|---|---|---|
| DE | 9218011 | 11/1993 |
| EP | 0 390 585 A | 10/1990 |

* cited by examiner

INTEGRAL ZIPPER SLIDE AND GUARD

REFERENCE TO RELATED APPLICATION

This application is a continuation-in-part of U.S. patent application Ser. No. 10/104,561, filed Mar. 21, 2002 now U.S. Pat. No. 6,701,584, and entitled "Zipper Guard", incorporated herein by reference.

TECHNICAL FIELD OF THE INVENTION

The present invention relates generally to zippers, and more specifically to zipper guards for reducing zipper snags.

BACKGROUND OF THE INVENTION

In general, a zipper is a fastener having two rows of metal or plastic meshing elements, often called "coils" or "teeth." Each row of teeth is mounted on a strip of fabric, called a "stringer." The two stringers together form the "zipper tape." A sliding piece, called a "slider" or "slide" closes an opening by drawing the rows of teeth together and meshing them into a connected structure.

A zipper slide typically includes a throat at the front of the slide. The throat receives the two open (i.e., not attached) rows of teeth. Channels within the slide direct the two rows together where they are joined, connected, and closed. A mouth at the rear portion of the slide fits around the adjacent closed rows of teeth.

One problem encountered with zippers is that often fabric or another item may be positioned where it is in the way of movement of the slide, and may eventually be caught between the slide and the teeth, or between the two rows of teeth. As such, the slide may become snagged or the teeth may be improperly separated.

Guards that mount on zipper slides have been developed for the purpose of minimizing snags between the zipper slide, zipper teeth, and surrounding fabric material. The guards attach to the slide, and are designed to block objects from entering the throat of the slide. Although these zipper guards often work well for their intended purpose, their structure can be somewhat complicated and the guards can be difficult to mount on the zipper slides.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention provides an integral zipper slide and guard. The integral slide and guard is formed as a single unit, thus alleviating previous problems of attachment of zipper guards to zipper slides. Moreover, the unitary structure of the zipper slide and guard permits a one-step molding operation, thus providing inexpensive manufacture of the integral zipper slide and guard.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
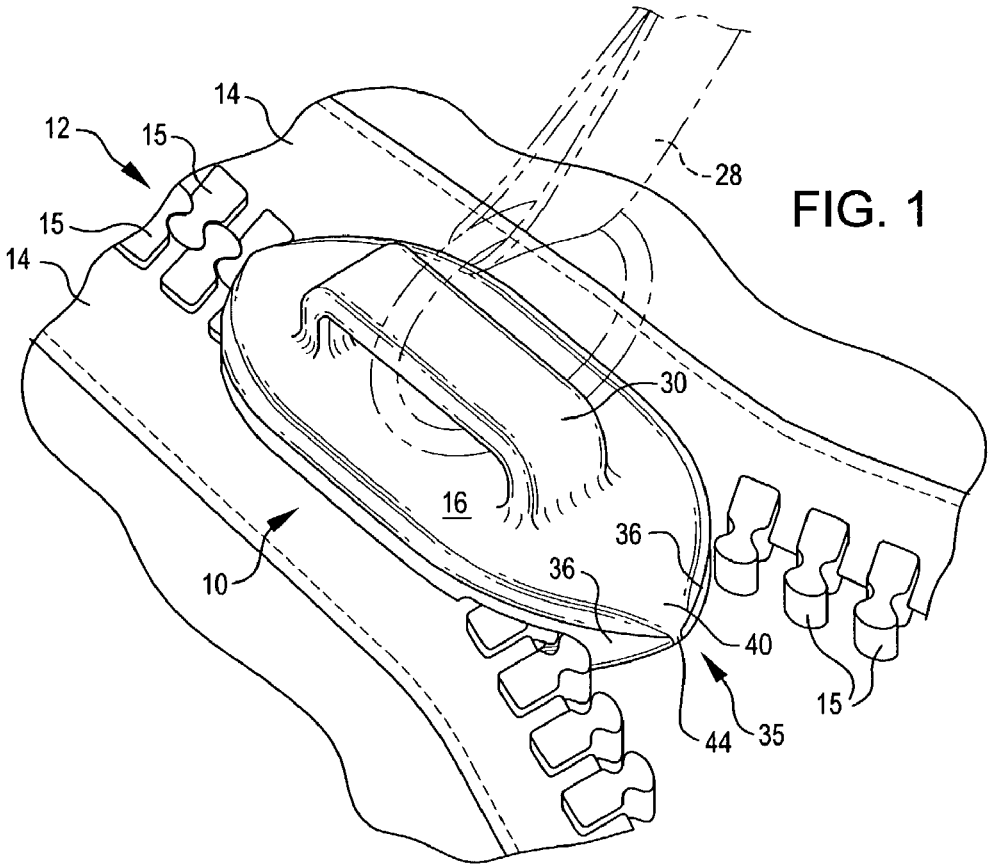
FIG. 1 is a top perspective view of an integral zipper slide and guard constructed in accordance with an embodiment of the invention and fitted to a zipper tape.

Referring now to the drawings, in which like reference numerals represent like parts throughout the several views, FIG. 1 shows an integral zipper slide and guard 10 in accordance with an embodiment of the present invention. The integral zipper slide and guard 10 is shown mounted on a zipper tape 12 having two stringers 14 with rows of teeth 15 on inner edges thereof. Briefly described, the integral zipper slide and guard 10 is configured and arranged so as to open and close the teeth 15 of the zipper tape 12 when the integral zipper slide and guard 10 is moved therealong.

In the embodiment shown in the drawings, the integral zipper slide and guard 10 is symmetrical about a vertical axis extending the length of the integral zipper slide and guard 10 (i.e., in the direction of the teeth 15 in FIG. 1). Thus, to the extent a side of the integral zipper slide and guard 10 is described, the other side includes identical, albeit mirror-image elements. Although the embodiment shown includes symmetrical sides, an integral zipper slide and guard may be formed in accordance with the present invention that is non-symmetrical.

Figure 3:
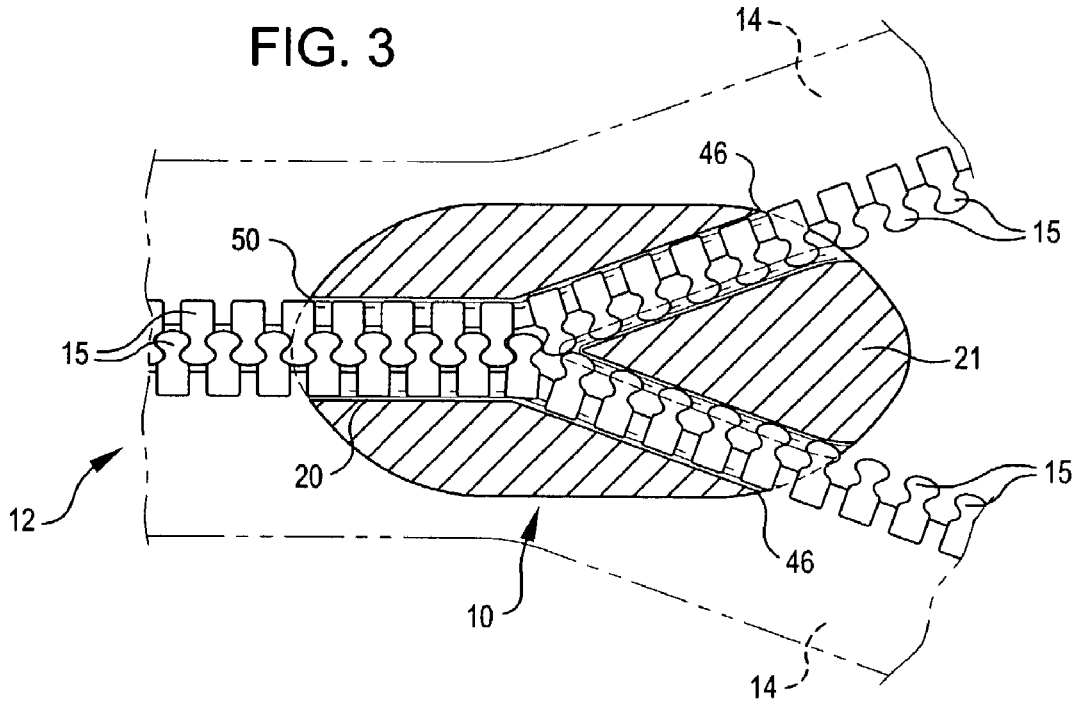
FIG. 3 is a bottom sectional view of the integral zipper slide and guard of FIG. 1, shown mounted on the zipper tape.
Figure 4:
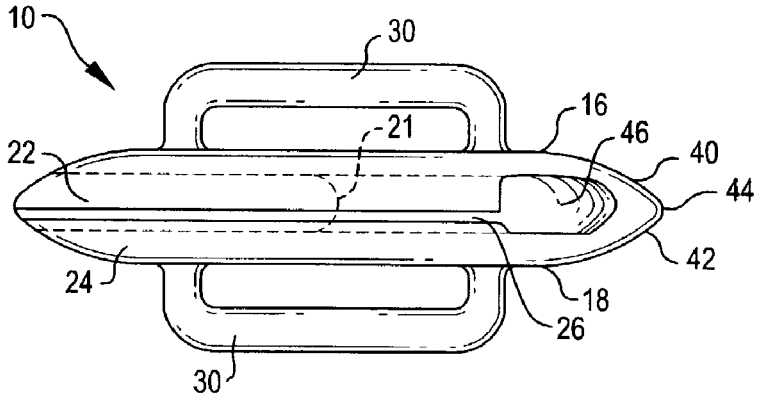
FIG. 4 is a side view of the integral zipper slide and guard of FIG. 1.

The integral zipper slide and guard 10 includes a first or upper slide plate 16 spaced from a second or lower slide plate 18 (FIG. 4). The upper and lower slide plates 16, 18 together define a central channel 20 (FIG. 3) through which the teeth 15 are guided. As can be seen in FIG. 3, a post 21 interconnects the upper and lower slide plates 16, 18.

Pairs of first and second side walls 22, 24, respectively, extending toward one another from the upper and lower slide plates 16, 18 and define a pair of longitudinally-extending slots 26. The slots 26 allow for the passage of the stringers 14 to which the rows of teeth 15 are connected.

In the example shown in the drawings, the integral zipper slide and guard 10 is shown fitted with a single slide pull tab 28 (shown in phantom in FIG. 1). The pull tab 28 is pivotally connected to a pull tab lug 30 extending upwardly from a central portion of the upper slide plate 16. While a single pull tab 28 is shown in the drawings, the integral zipper slide and guard 10 may alternatively include two or more pull tabs 28, and/or an additional pull tab lug 30 on the lower slide plate 18. Such a second pull tab lug 30 is shown in FIG. 4.

The integral zipper slide and guard 10 is preferably formed as a one-piece homogenous plastic molding. The plastic is selected to have a significant abrasion resistance.

A particularly suitable plastic is acetyl plastic, but any other tough and somewhat resilient plastic can provide acceptable performance. Plastic is preferred to metals, as plastic will cause less wear on modern plastic zipper teeth 15 than a similar integral zipper slide and guard 10 formed of metal, and plastic can be easily and economically molded.

Figure 2:
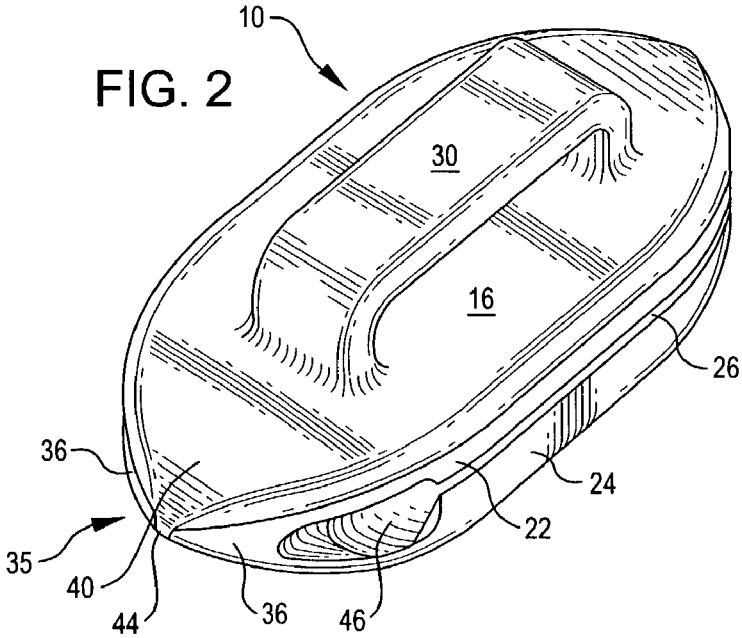
FIG. 2 is a top, front perspective of the integral zipper slide and guard of FIG. 1.

As can be seen in FIGS. 1 and 2, the integral zipper slide and guard 10 is formed with a tapered or rounded leading edge portion or nose portion 35 having forwardly converging side walls 36. The side walls 36 diverge rearwardly to the split side walls 22, 24. The front portions of an upper surface 40 and lower surface 42 (FIG. 4) of the integral zipper slide and guard 10 taper forwardly toward one another as they converge at a tip 44 of the nose portion 35.

The converging sidewalls 36 and upper surface 40 and lower surface 42 cause the nose portion 35 to be formed as a compound wedge. A first wedge is defined by the forwardly converging front side walls 36. A second wedge is defined by the forwardly converging upper and lower surfaces 40 and 42. This compound wedge acts as a plow to clear away fabric and other material that would otherwise cause a zipper snag if allowed to enter front entrances 46 of the integral zipper slide and guard 10 and then into the central channel 20.

The compound wedge shape in the embodiment shown in the drawings is formed by four distinct surfaces (i.e., the side walls 36, the top surface 40 and the bottom surface 42). However, the compound wedge may be more rounded or may be oddly shaped so that these walls and surfaces are not so clearly defined.

The integral zipper slide and guard 10 includes a similar compound wedge configuration at it rear portion. However, instead of front entrances 46, a single opening 50 (FIG. 3) is provided at the juncture of the converging side walls and rear and top surfaces. This compound wedge acts as a plow to clear away fabric and other material that would otherwise cause a zipper snag when the integral zipper slide and guard 10 is moved backward.

As can be seen in FIGS. 2, 3, and 4, both ends of the integral zipper slide and guard 10 has a somewhat bullet-shaped profile from front and rear when viewed from above, below, and from either side. Front and rear views define a generally rectangular profile.

The front entrances 46 formed in the integral zipper slide and guard 10 through each of the front side walls 36 converge rearwardly to the central channel 20 and out to the opening 50. The teeth 15 extending into the front entrances 46 are attached in the central channel 20 in a known manner when the integral zipper slide and guard 10 is moving forward. The attached teeth extend out of the rear opening 50. When moving rearwardly, the teeth 15 are detached from one another, also in a known manner.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A zipper slide, comprising:

a forward end configured to receive two disconnected rows of zipper teeth and defining front side walls and front upper said front lower surfaces;

a rearward end configured to receive a connected end of the two rows and defining rear side walls and rear upper and rear lower surfaces;

a front guard attached to the forward end and comprising:

a first wedge defined by the front side walls forwardly converging; and a second wedge defined by the front upper and front lower surfaces forwardly converging; and a rear guard comprising:

a third wedge defined by the rear side walls rearwardly converging; and a fourth wedge defined by the rear upper and front lower surfaces rearwardly converging.

2. The zipper slide of claim 1, wherein the rear guard is formed as a single, unitary piece with the slide.

3. The zipper slide of claim 1, further comprising an opening at the convergence of the rear and front side walls configured and arranged to receive the connected end of the two rows.

4. A zipper slide, comprising:

a forward end configured to receive two disconnected rows of zipper teeth;

a rearward end configured to receive a connected end of the two rows;

a bullet-shaped front guard attached to the forward end and comprising:

first and second openings for receiving the two disconnected rows of zipper teeth; and a forward tip extending beyond the first and second openings; and a rear guard comprising:

converging rear side walls; and converging rear upper and front lower surfaces.

5. The tipper slide of claim 4, wherein the rear guard is formed as a single, unitary piece with the slide.

6. The zipper slide of claim 4, further comprising an opening at the convergence of the rear and front side walls configured and arranged to receive the connected end of the two rows.

* * * * *